US008647152B2

(12) United States Patent
Sugiyama

(10) Patent No.: US 8,647,152 B2
(45) Date of Patent: Feb. 11, 2014

(54) HIGH VOLTAGE CONNECTOR

(75) Inventor: Norio Sugiyama, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/581,259

(22) PCT Filed: Oct. 27, 2011

(86) PCT No.: PCT/JP2011/074823

§ 371 (c)(1),
(2), (4) Date: Aug. 24, 2012

(87) PCT Pub. No.: WO2012/066919

PCT Pub. Date: May 24, 2012

(65) Prior Publication Data

US 2012/0322311 A1 Dec. 20, 2012

(30) Foreign Application Priority Data

Nov. 15, 2010 (JP) ..... P2010-254754

(51) Int. Cl.
*H01R 13/40* (2006.01)

(52) U.S. Cl.
USPC ..... 439/625

(58) Field of Classification Search
USPC ..... 439/625–626, 540.1, 278, 638, 733.1, 439/607.28
See application file for complete search history.

(56) References Cited

U.S. PATENT DOCUMENTS

| | | | | |
|---|---|---|---|---|
| 2001/0053632 | A1* | 12/2001 | Sukagawa | 439/625 |
| 2011/0235977 | A1* | 9/2011 | Yamada | 385/76 |
| 2012/0094539 | A1* | 4/2012 | Ooki | 439/625 |
| 2012/0220166 | A1* | 8/2012 | Fischer et al. | 439/626 |

FOREIGN PATENT DOCUMENTS

| | | |
|---|---|---|
| JP | 11-154548 | 6/1999 |
| JP | 2002-170606 | 6/2002 |
| JP | 2004-327184 | 11/2004 |

* cited by examiner

*Primary Examiner* — Jean F Duverne
(74) *Attorney, Agent, or Firm* — Finnegan, Henderson, Farabow, Garrett & Dunner, L.L.P.

(57) ABSTRACT

A high voltage connector (1) includes: a connector housing (2) formed of a high rigid material, and having a terminal housing portion (3) in which both sides are partitioned by a first partition wall (5) and a second partition wall (6), an engaging protrusion (7) provided on the first partition wall (5) side, and a tapered rib (8) that is provided on the second partition wall (6) side and is inclined in a direction of gradually protruding into the terminal housing portion (3) as going from an inlet side of the terminal housing portion (3) toward a depth of the terminal housing portion (3); and a terminal (10) to be housed in the terminal housing portion (3).

4 Claims, 6 Drawing Sheets

HIGH VOLTAGE CONNECTOR

TECHNICAL FIELD

The present invention relates to a high voltage connector.

BACKGROUND ART

For example, high voltage and high current are supplied to a motor of an electric vehicle. A high voltage connector is used for a wiring connection portion of a supply route of a power supply for such a purpose. Heretofore, various types have been proposed as such a high voltage connector (refer to PTL 1).

FIGS. 1 to 3 illustrate a conventional example of the high voltage connector. In FIGS. 1 and 2, a high voltage connector 100 according to the conventional example includes: a connector housing 101; and three terminals 110 mounted in the connector housing 101.

The connector housing 101 has three terminal housing portions 102 arranged in parallel to one another. Each of the terminal housing portions 102 is surrounded by a bottom surface wall 103 and partition walls 104 on both sides thereof. On the partition walls 104 on both sides, a pair of engaging protrusions 105 are provided. Each of the engaging protrusions 105 protrudes to a terminal housing portion 102 side, and a bottom surface thereof is defined as an engaging surface 105*a*.

The terminal 110 has a rectangular plate shape. The terminal 110 is engaged with the pair of engaging protrusions 105, and is thereby mounted into each of the terminal housing portions 102. In mounting the terminal 110, as illustrated in FIG. 3, the terminal 110 is inserted into the terminal housing portion 102 while making the terminal 110 substantially parallel to the bottom surface wall 103 of the terminal housing portion 102. Then, though both end portions of the terminal 110 interfere with the pair of engaging protrusions 105, the terminal 110 is mounted into the terminal housing portion 102 by pushing the terminal 110 thereinto while resisting interference drags of the pair of engaging protrusions 105.

CITATION LIST

Patent Literature

[PTL 1] JP 2004-327184 A

SUMMARY OF INVENTION

Incidentally, high thermal resistance is required for the connector housing 101 for use in the high voltage connector 100. A high thermal resistance material (for example, glass-reinforced resin) has high rigidity in usual, and the connector housing 101 formed of such a material becomes a high rigid structure. Hence, in the event of pushing the terminal 110 into the terminal housing portion 102, the terminal 110 will apply large external force to the engaging protrusions 105, and particularly, to corner portions thereof. In such a way, the corner portions of the engaging protrusions 105 are cut off as illustrated in FIG. 4, and problems that engagement force by the pair of engaging protrusions 105 is lowered and that the terminal 110 cannot be engaged therewith at worst are considered.

The present invention has been made in order to solve the above-mentioned problems. It is an object of the present invention to provide a high voltage connector in which a connector housing is formed of a high rigid material, the high voltage connector being capable of surely engaging terminals therewith by desired engagement force.

A high voltage connector according to a first aspect of the present invention includes: a connector housing formed of a high rigid material, and having a terminal housing portion in which both sides are partitioned by a first partition wall and a second partition wall, an engaging protrusion provided on the first partition wall side, and a tapered rib that is provided on the second partition wall side and is inclined in a direction of gradually protruding into the terminal housing portion as going from an inlet side of the terminal housing portion toward a depth of the terminal housing portion; and a terminal to be housed in the terminal housing portion.

Preferably, the connector housing includes a straight rib provided on the first partition wall side. In this case, a protruding amount of the straight rib just needs to be set at a dimension equal to or larger than a protruding amount of the engaging protrusion.

Preferably, the terminal has a first notched portion for receiving entrance of the tapered rib.

Moreover, in the case of including the straight rib, preferably, the terminal has a second notched portion for receiving entrance of the straight rib.

In accordance with the high voltage connector according to the first aspect of the present invention, the terminal inserted into the terminal housing portion is inclined, and one of end surfaces of the terminal is allowed to enter the terminal housing portion to a position beyond the engaging protrusion, and thereafter, the other of the end surfaces of the terminal is slid and pushed into the tapered rib. In such a way, the terminal can be mounted into the terminal housing portion. Hence, the terminal can be mounted into the terminal housing portion without applying large external force to the engaging protrusion. From the above, even if the connector housing is formed of the high rigid material, the engaging protrusion is not broken or so on when the terminal is mounted into the terminal housing portion. As a result, the terminal is surely engaged with the connector housing by desired engagement force.

DESCRIPTION OF EMBODIMENTS

A description is made below of an embodiment of the present invention based on the drawings.

Figure 1:
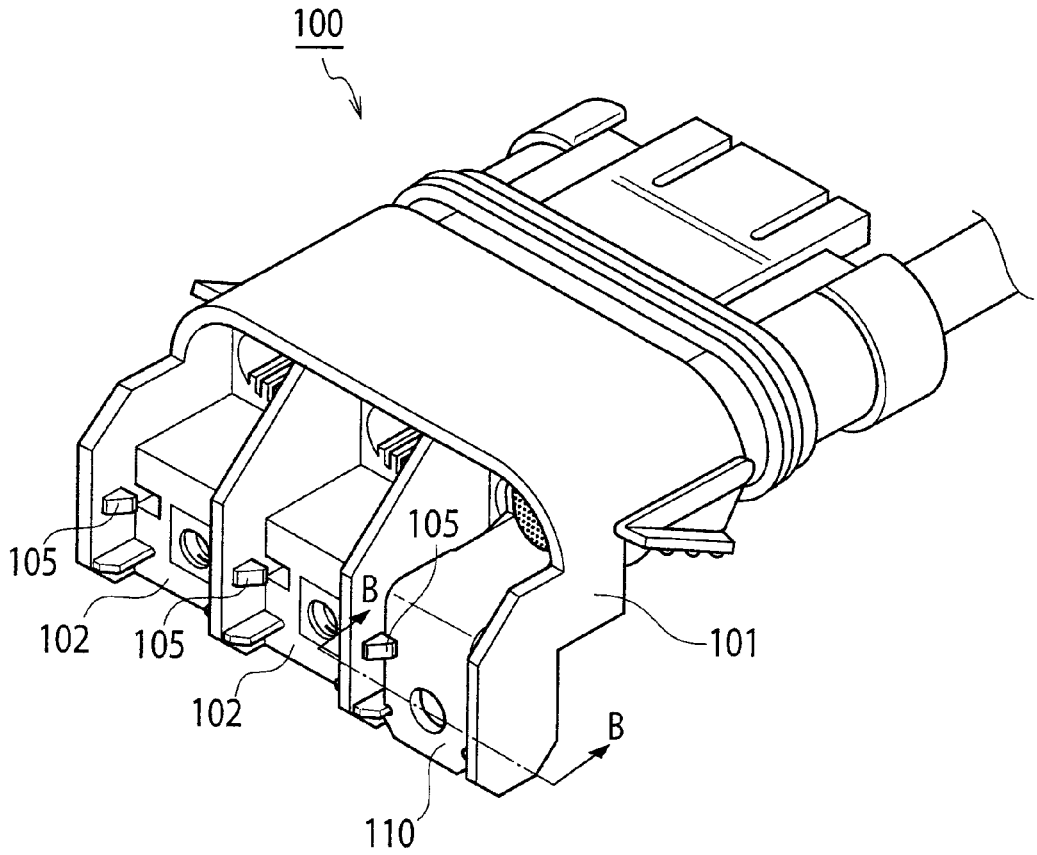
FIG. 1 is a perspective view of a connector according to a conventional example.
Figure 2:
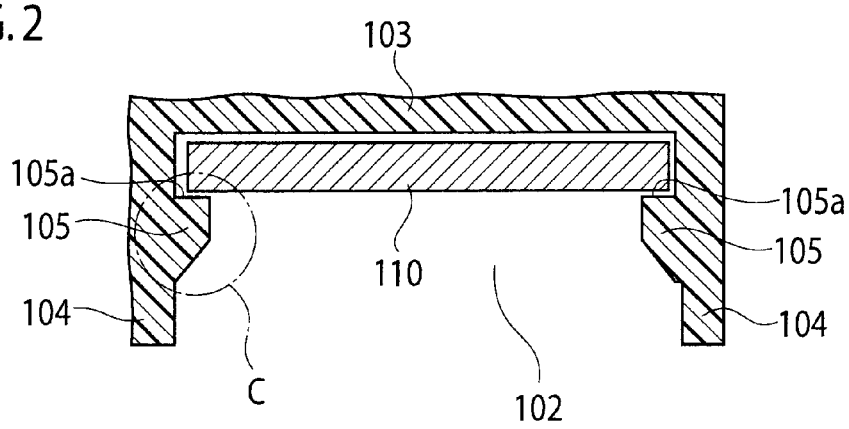
FIG. 2 is a cross-sectional view of the connector according to the conventional example illustrated in FIG. 1, taken along a line B-B.
Figure 3:
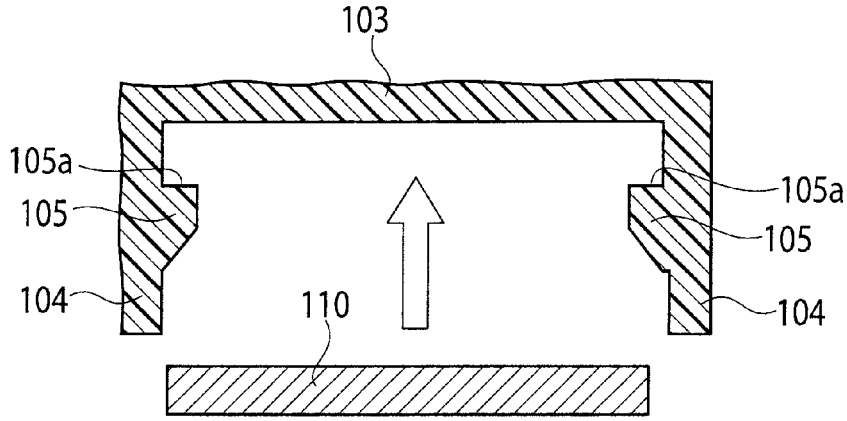
FIG. 3 is a cross-sectional view illustrating a mounting start state of a terminal in the connector according to the conventional example.
Figure 4:
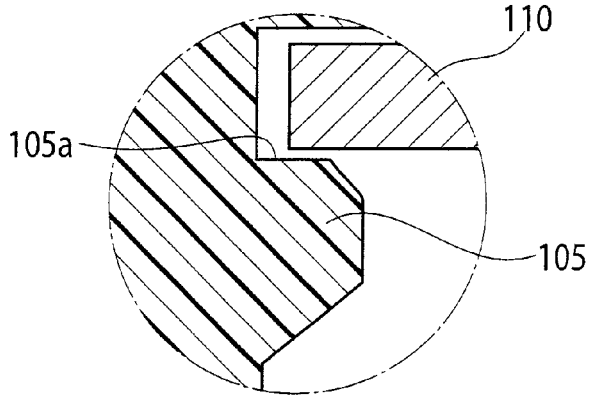
FIG. 4 is an enlarged view of a portion C of FIG. 2, illustrating a state where a corner portion of an engaging protrusion is cut off.
Figure 5:
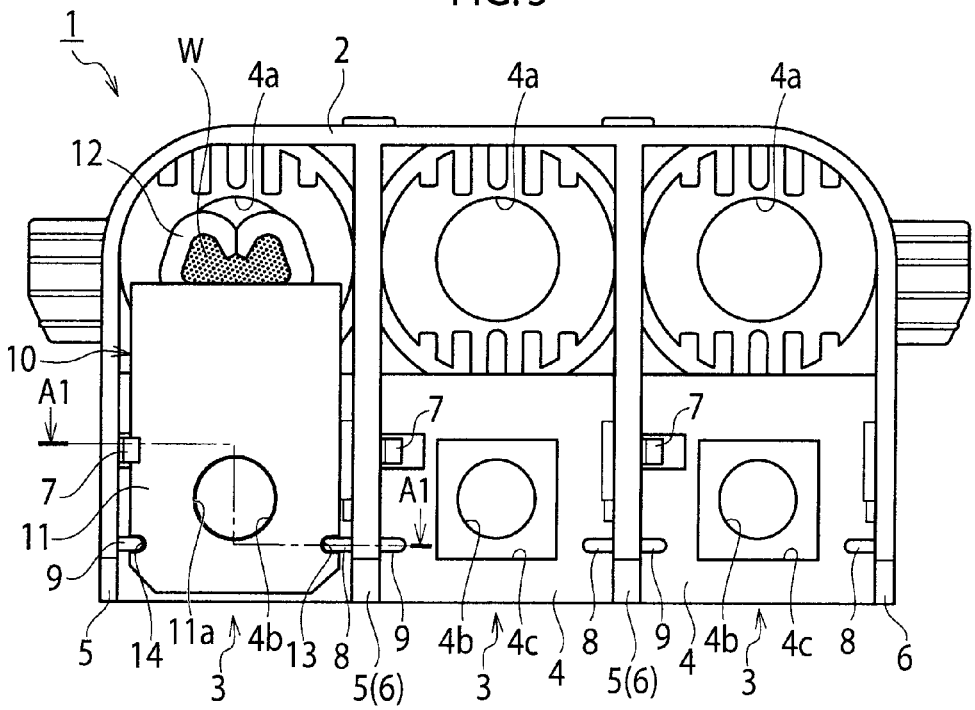
FIG. 5 is a plan view of a high voltage connector according to an embodiment of the present invention, illustrating a state where mounting of one terminal into a connector housing is completed.
Figure 6:
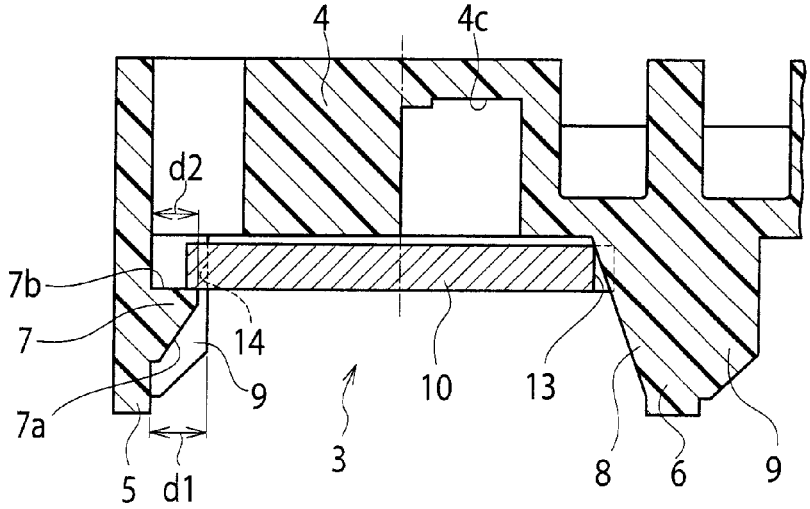
FIG. 6 is a cross-sectional view taken along a line A1-A1 of FIG. 5.

FIGS. 5 to 11 illustrate the embodiment of the present invention. As illustrated in FIGS. 5 and 6, a high voltage connector 1 according to the embodiment includes: a connector housing 2; and three terminals 10 mounted in the connector housing 2. Note that FIG. 5 illustrates a state where one terminal 10 is mounted.

The connector housing 2 is formed of a high thermal resistance material (for example, glass-reinforced resin). In such a way, the connector housing 2 is formed as a high rigid structure made of a high rigid material. The connector housing 2 has three terminal housing portions 3 arranged in parallel to one another. Each terminal housing portion 3 is surrounded by a bottom surface wall 4 and by a first partition wall 5 and a second partition wall 6, which protrude from the bottom surface wall 4. In the bottom surface wall 4 of the terminal housing portion 3, an electric wire insertion hole 4*a* and a bolt entry hole 4*b* are formed. In the bottom surface wall 4 of the terminal housing portion 3, a recessed portion 4*c* for press-fitting a nut thereinto is formed so as to surround the bolt entry hole 4*b*.

On the first partition wall 5 of each of the terminal housing portions 3, an engaging protrusion 7 is protruded. A surface of the engaging protrusion 7 on an inlet side of the terminal housing portion 3 is defined as a tapered surface 7*a*. A surface of the engaging protrusion 7 on a depth side of the terminal housing portion 3 is defined as a perpendicular engaging surface 7*b*. A dimension between the engaging surface 7*b* and the bottom surface wall 4 is set at the same dimension as or a little larger dimension than a thickness of the terminal 10. That is to say, the dimension concerned is set at a dimension at which an end surface of the terminal 10 can be inserted into the terminal housing portions 3.

On the first partition wall 5 and the second partition wall 6, which are located on both sides of each of the terminal housing portions 3, a tapered rib 8 and a straight rib 9 are protruded at positions opposite to each other. The tapered rib 8 is provided on the second partition wall 6. The tapered rib 8 is inclined in a direction of gradually protruding into the terminal housing portion 3 as going from the inlet side of the terminal housing portion 3 toward a depth thereof. The straight rib 9 is provided on the first partition wall 5, that is, on a partition wall on the same side as the engaging protrusion 7. The straight rib 9 protrudes by the same dimension from the inlet side of the terminal housing portion 3 toward the depth thereof. A protruding amount d1 of the straight rib 9 is set at a dimension equal to or larger than a protruding amount d2 of the engaging protrusion 7.

Figure 7:
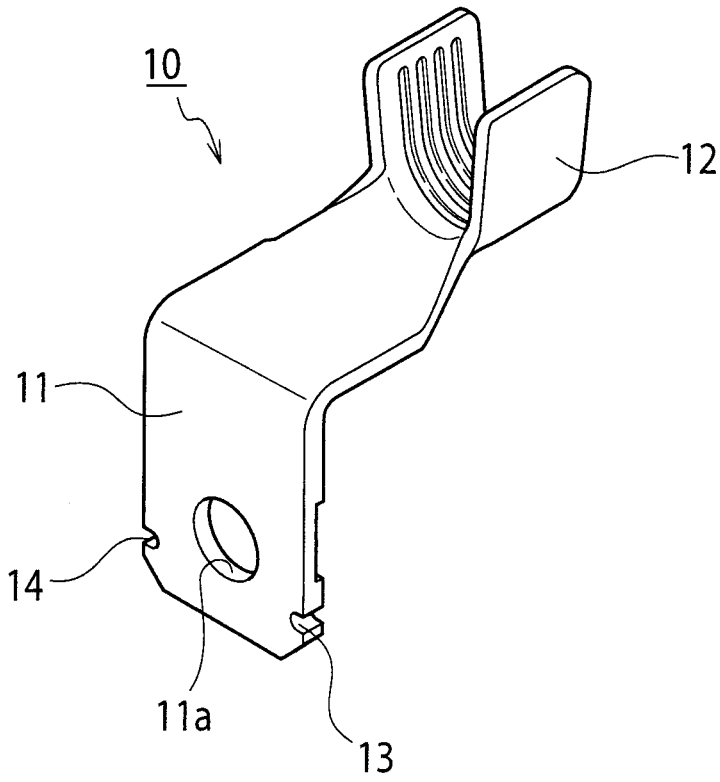
FIG. 7 is a perspective view of a terminal in the high voltage connector according to the embodiment of the present invention.

As illustrated in FIG. 7 in detail, each terminal 10 is formed of a metal material (busbar) as a conductor. The terminal 10 is composed of: an other-party terminal contact portion 11; and an electric wire crimp portion 12 bent in a direction substantially orthogonal to the other-party terminal contact portion 11. The other-party terminal contact portion 11 has a rectangular shape, and a width thereof is set at a little narrower width than a width dimension of the terminal housing portion 3. In the other-party terminal contact portion 11, a bolt through hole 11*a* is formed. On both sides of the other-party terminal contact portion 11, a first notched portion 13 and a second notched portion 14 are formed at positions opposite to each other. The first notched portion 13 is set at a width at which the tapered rib 8 enters the same without any gap. The second notched portion 14 is set at a width at which the straight rib 9 enters the same without any gap.

To the electric wire crimp portion 12, an end portion of an electric wire W is connected by crimping.

Next, a description is made of a mounting operation of the terminal 10 into the terminal housing portion 3.

Figure 8:
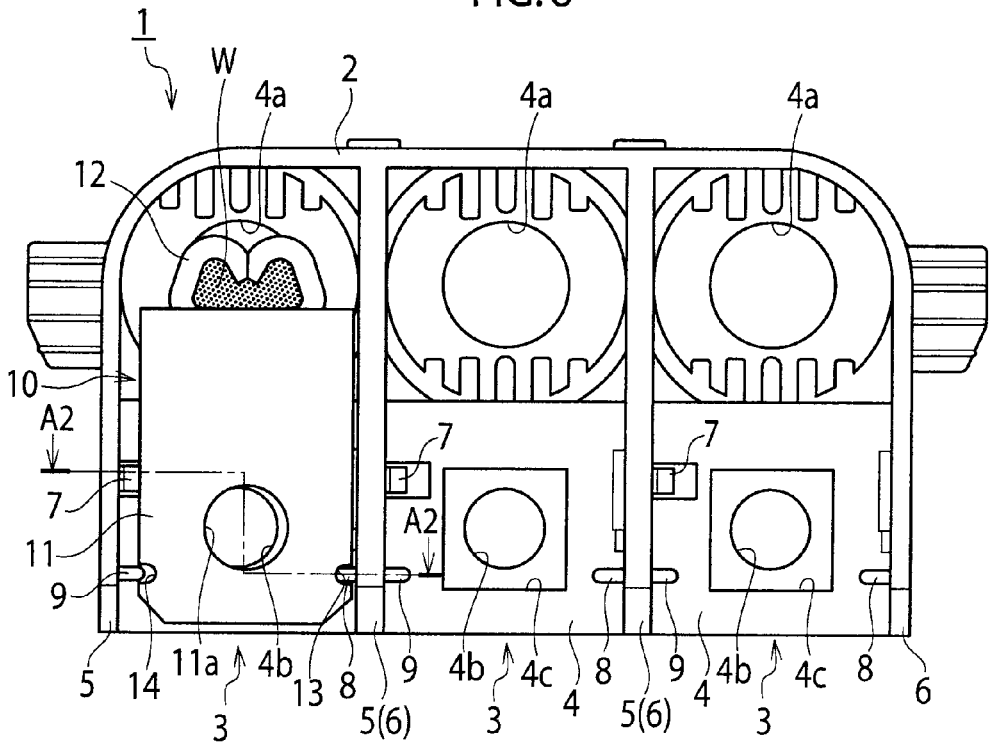
FIG. 8 is a plan view of the high voltage connector according to the embodiment of the present invention, illustrating a state where insertion of the terminal is started.
Figure 9:
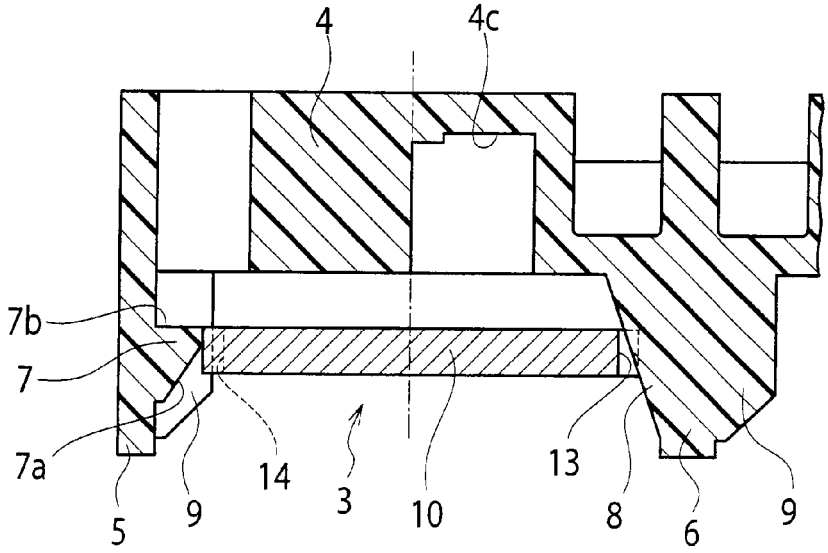
FIG. 9 is a cross-sectional view taken along a line A2-A2 of FIG. 8.

First, the first notched portion 13 and second notched portion 14 of the terminal 10 are positionally aligned with the tapered rib 8 and straight rib 9 of the terminal housing portion 3, and the terminal 10 is inserted into the terminal housing portion 3 while making the terminal 10 substantially parallel to the bottom surface wall 4. Then, as illustrated in FIGS. 8 and 9, the second notched portion 14 is located at a position in close contact with and facing to the straight rib 9, and the tapered rib 8 enters the first notched portion 13. In such a way, the first notched portion 13-side of the terminal 10 turns to a state of being positioned by the tapered rib 8.

Figure 10:
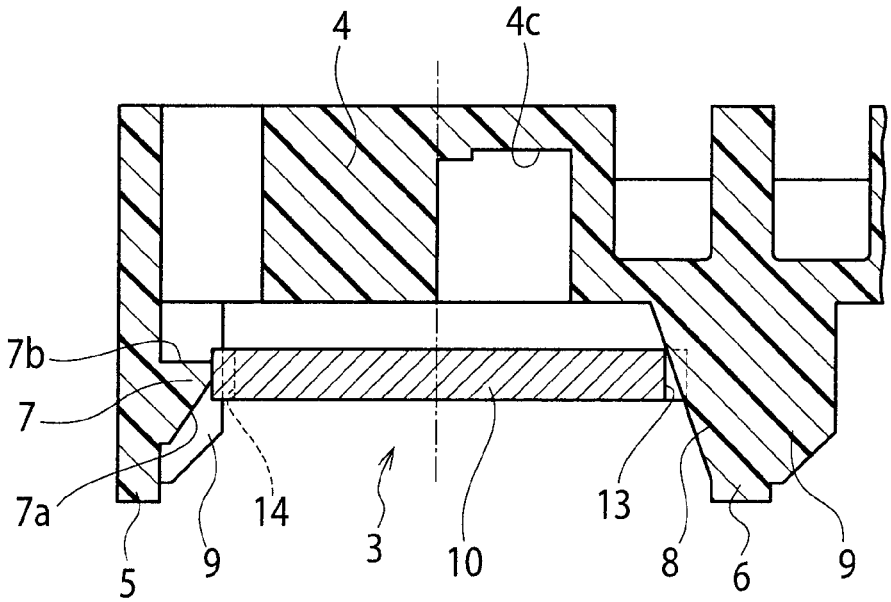
FIG. 10 is a cross-sectional view of the high voltage connector according to the embodiment of the present invention, illustrating a state where the terminal is inserted a little into a terminal housing portion from a state of FIG. 9.

Next, as illustrated in FIG. 10, the terminal 10 is inserted into the terminal housing portion 3 in a state of being substantially parallel to the bottom surface wall 4. Then, since the tapered rib 8 has entered the first notched portion 13 of the terminal 10, the terminal 10 is inserted into the terminal housing portion 3 while being guided by an inclined surface of the tapered rib 8. In a process of this insertion, the terminal 10 is inserted into the terminal housing portion 3 while being horizontally shifted to the straight rib 9 side. Therefore, the straight rib 9 enters the second notched portion 14 of the terminal 10 a little. In such a way, the terminal 10 turns to a state where both end sides thereof are positioned by the tapered rib 8 and the straight rib 9. Moreover, at this time, a second notched portion 14-side end surface of the terminal 10 is located at a position of being almost brought into contact with the engaging protrusion 7.

Figure 11:
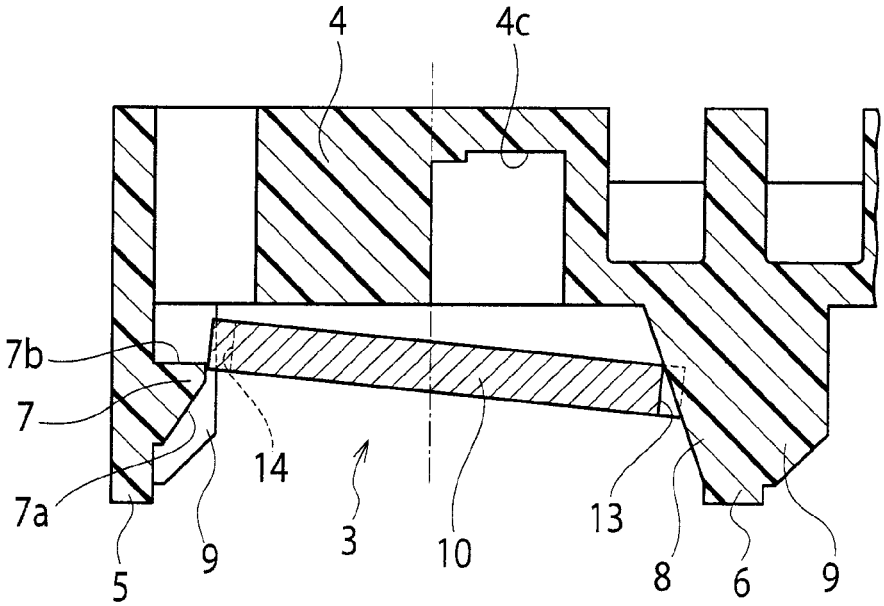
FIG. 11 is a cross-sectional view of the high voltage connector according to the embodiment of the present invention, illustrating a state where, from a state of FIG. 10, the terminal is inserted into the terminal housing portion to a position where one end surface thereof gets over an engaging protrusion.

When the second notched portion 14-side end surface of the terminal 10 is located at the position of being almost brought into contact with the engaging protrusion 7, then, as illustrated in FIG. 11, only the second notched portion 14 side of the terminal 10 is inserted into the terminal housing portion 3. That is to say, the terminal 10 is obliquely inserted into the terminal housing portion 3. Therefore, the second notched portion 14-side end surface of the terminal 10 becomes insertable into the terminal housing portion 3 without applying large external force to the engaging protrusion 7. Then, when the second notched portion 14-side end surface of the terminal 10 gets over the engaging protrusion 7, a first notched portion 13-side end surface of the terminal 10 is inserted into the depth of the terminal housing portion 3. Then, the terminal 10 is inserted into the terminal housing portion 3 while the first notched portion 13 of the terminal 10 is being guided by the inclined surface of the tapered rib 8. Therefore, the straight rib 9 enters the second notched portion 14 of the terminal 10 gradually deeply, and the second notched portion 14-side of the terminal 10 gradually enters a space between the engaging surface 7*b* of the engaging protrusion 7 and the bottom surface wall 4. As illustrated in FIG. 5, when the terminal 10 is inserted to the position of becoming substantially parallel to the bottom surface wall 4, the second notched portion 14-side end surface of the terminal 10 sufficiently enters the space between the engaging surface 7*b* of the engaging protrusion 7 and the bottom surface wall 4. In such a way, the mounting operation of the terminal 10 into the terminal housing portion 3 is completed.

As described above, the high voltage connector 1 includes: the connector housing 2 having the terminal housing portions 3 in each of which both sides are partitioned by the first partition wall 5 and the second partition wall 6, the engaging protrusion 7 provided on the first partition wall 5 side, and the tapered rib 8 which is provided on the second partition wall 6 side and is inclined in the direction of gradually protruding into each terminal housing portion 3 as going from the inlet side of the terminal housing portion 3 toward the depths thereof; and the terminals 10 each housed in the corresponding terminal housing portion 3. Hence, as described in the above-mentioned mounting operation of the terminal 10, the terminal 10 is mounted in the corresponding terminal housing portion 3 without allowing the terminal 10 to apply the large external force to the engaging protrusion 7. From the above, even if the connector housing 2 is formed of the high rigid material, the terminal 10 can be mounted into the terminal housing portion 3 without breaking the engaging protrusion 7 or so on. As a result, the terminal 10 is surely engaged with the engaging protrusion 7 of the connector housing 2 by desired engagement force.

The connector housing 2 has the straight rib 9 provided on each first partition wall 5 side, and the protruding amount d1 of the straight rib 9 is set at the dimension equal to or larger than the protruding amount d2 of the engaging protrusion 7. Hence, the terminal 10 can be mounted into the terminal housing portion 3 without abutting against the engaging protrusion 7 as much as possible. As a result, when the terminal 10 is mounted into the terminal housing portion 3, a possibility that the engaging protrusion 7 may be broken and so on can be lowered.

In this embodiment, the second notched portion 14 is provided on the terminal 10, and accordingly, the straight rib 9 is set at a length reaching the bottom surface wall 4 from the inlet side of the terminal housing portion 3 beyond the engaging protrusion 7. However, in the case where the second notched portion 14 is not provided on the terminal 10, the straight rib 9 is set at a length from the inlet side of the terminal housing portion 3 to position of the engaging surface 7*b* of the engaging protrusion 7.

Moreover, the terminal 10 has the first notched portion 13 which the tapered rib 8 enters. In such a process of mounting the terminal 10, the first notched portion 13 functions as a positioning member for insertion position of the terminal 10, and as a guide for inserting the terminal 10 along a predetermined route. Therefore, the terminal 10 is mounted into the terminal housing portion 3 surely and smoothly. Moreover, in comparison with the case where the terminal 10 does not have the first notched portion 13, intervals between the terminal 10 housed in the terminal housing portion 3 and the partition walls 5 and 6 can be reduced. Therefore, the terminal housing portion 3 can be made compact. Moreover, after the mounting of the terminal 10 into the terminal housing portion 3 is completed, the first notched portion 13 functions to position the terminal 10.

Moreover, the terminal 10 has the second notched portion 14 which the straight rib 9 enters. In the process of mounting the terminal 10, the second notched portion 14 functions as a positioning member for the insertion position of the terminal 10, and as a guide for inserting the terminal along the predetermined route. Therefore, the terminal 10 is mounted into the terminal housing portion 3 surely and smoothly. Moreover, in comparison with the case where the terminal 10 does not have the second notched portion 14, the intervals between the terminal 10 housed in the terminal housing portion 3 and the partition walls 5 and 6 can be reduced. Therefore, the terminal housing portion 3 can be made compact. Moreover, after the mounting of the terminal 10 is completed, the second notched portion 14 functions to position the terminal 10.

Furthermore, in this embodiment, the terminal 10 has both of the first notched portion 13 and the second notched portion 14. Therefore, a synergy of the above-mentioned effects of the first notched portion 13 and the second notched portion 14 can be expected. Specifically, the operability in mounting the terminal 10 can be further enhanced, the terminal housing portion 3 can be made more compact, and after the mounting of the terminal 10 into the terminal housing portion 3 is completed, the terminal 10 can be positioned in the terminal housing portion 3 more surely.

The invention claimed is:

1. A high voltage connector comprising:

a connector housing formed of a high rigid material, and including a terminal housing portion in which both sides are partitioned by a first partition wall and a second partition wall, an engaging protrusion provided on the first partition wall side, and a tapered rib that is provided on the second partition wall side and is inclined in a direction of gradually protruding into the terminal housing portion as going from an inlet side of the terminal housing portion toward a depth of the terminal housing portion; and a terminal to be housed in the terminal housing portion.

2. The high voltage connector according to claim 1, wherein the connector housing includes a straight rib provided on the first partition wall side, and a protruding amount of the straight rib is set at a dimension equal to or larger than a protruding amount of the engaging protrusion.

3. The high voltage connector according to claim 1, wherein the terminal has a first notched portion for receiving entrance of the tapered rib.

4. The high voltage connector according to claim 2, wherein the terminal has a second notched portion for receiving entrance of the straight rib.

* * * * *